United States Patent [19]

Echtler et al.

[11] 4,318,331

[45] Mar. 9, 1982

[54] AUTOMATIC AMMUNITION LOADING APPARATUS FOR AN ARMORED VEHICLE

[75] Inventors: Helmut Echtler, Biessenhofen; Peter Wimmer, Marktoberdorf, both of Fed. Rep. of Germany

[73] Assignee: Werkzeugmaschinenfabrik Oerlikon-Bührle AG, Zürich, Switzerland

[21] Appl. No.: 164,189

[22] Filed: Jun. 30, 1980

[30] Foreign Application Priority Data

Jul. 6, 1979 [CH] Switzerland ..... 6948/79

[51] Int. Cl.[3] ..... F41H 7/06

[52] U.S. Cl. ..... 89/46; 89/34; 89/47

[58] Field of Search ..... 89/33 A, 33 B, 33 BB, 89/34, 36 H, 36 K, 45, 46, 47

[56] References Cited

U.S. PATENT DOCUMENTS 4,038,906 8/1977 Tidstrom ..... 89/46

*Primary Examiner*—Stephen C. Bentley

*Attorney, Agent, or Firm*—Werner W. Kleeman

[57] ABSTRACT

At an armored vehicle containing a firing weapon, such as for instance a cannon, there is required an automatic loading apparatus, by means of which the rounds of ammunition or projectiles can be automatically infed to the firing weapon from an ammunition magazine arranged behind an armored turret of the armored vehicle. The loading apparatus removes the projectiles from two different containers. This loading apparatus comprises two withdrawal or removal devices, two pivot devices, a rotatable table containing two cartridge receiving locations or stations as well as an ammunition infeed device. This ammunition device comprises a lifting or hoisting device, a loading cradle or shell and a rammer.

15 Claims, 16 Drawing Figures

AUTOMATIC AMMUNITION LOADING APPARATUS FOR AN ARMORED VEHICLE

BACKGROUND OF THE INVENTION

The present invention broadly relates to the field of ordnance and armaments and, in particular, concerns improvements in ammunition handling systems. More specifically, the present invention concerns an automatic ammunition loading apparatus for an amored vehicle containing an armored turret in order to infeed projectiles to a firing weapon.

There are already known to the art the most various types of ammunition handling and loading systems, as exemplified for instance by the following prior art patents: U.S. Pat. No. 2,149,954; U.S. Pat. No. 2,474,575; U.S. Pat. No. 3,101,026; U.S. Pat. No. 3,122,967; U.S. Pat. No. 3,429,221; German Pat. No. 2,501,424; German Pat. No. 2,501,425; French Pat. No. 2,288,293; French Pat. No. 2,301,797 and French Pat. No. 2,404,827.

SUMMARY OF THE INVENTION

It is a primary object of the present invention to provide a new and improved construction of automatic ammunition loading apparatus for an armored vehicle, which is capable of automatically infeeding to the firing weapon ammunition which has been stored in an area or vat behind the turret cage in a manner precluding the need for rotating the vehicle turret into a particular loading position.

A further significant object of the present invention aims at providing an automatic ammunition loading apparatus for an armored vehicle, which is relatively simple in construction and design, extremely reliable in operation, not readily subject to breakdown or malfunction, requires a minimum of maintenance and servicing and enables automatic loading of rounds of ammunition from a given storage area to the firing weapon without the necessity of having to rotate the vehicle turret into a particular loading position.

Now in order to implement these and still further objects of the invention, which will become more readily apparent as the description proceeds, the automatic ammunition loading apparatus of the present development is manifested by the features that there is provided an ammunition magazine containing two ammunition containers. Each of the ammunition containers is provided with a respective drive and drive shafts and with a respective endless band or belt chain. A magazine chute or sluice is arranged between the ammunition magazine and the armored vehicle turret. The magazine chute contains a trap or drop door and an actuation cylinder for opening and closing the trap door. There is also provided a transfer station containing a withdrawal or removal device for withdrawing the projectiles out of the ammunition magazine through the magazine chute, a pivot device and a rotatable table to which are fed the projectiles by means of the pivot device. There is also provided an ammunition infeed device containing a lifting or hoisting device for hoisting the projectiles from the rotatable table below the vehicle turret up to the firing weapon. A loading shell or cradle serves to receive the projectiles which are to be hoisted, this loading shell or cradle is secured to the lifting or hoisting device, and a rammer serves to ram the raised projectiles into the firing weapon.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 3:
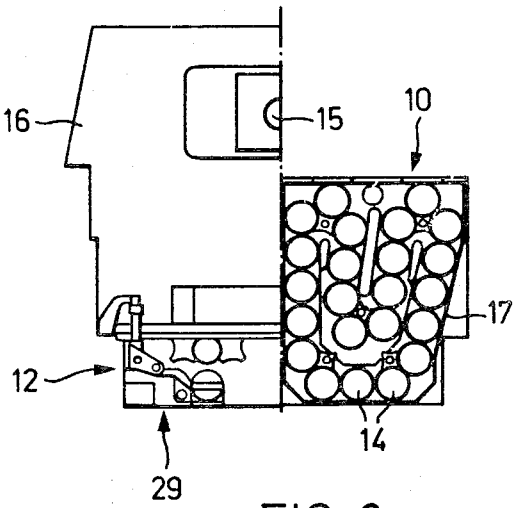
FIG. 3 is a cross-sectional view through the automatic ammunition loading apparatus of FIG. 2, taken substantially along the line III—III thereof.
Figure 1:
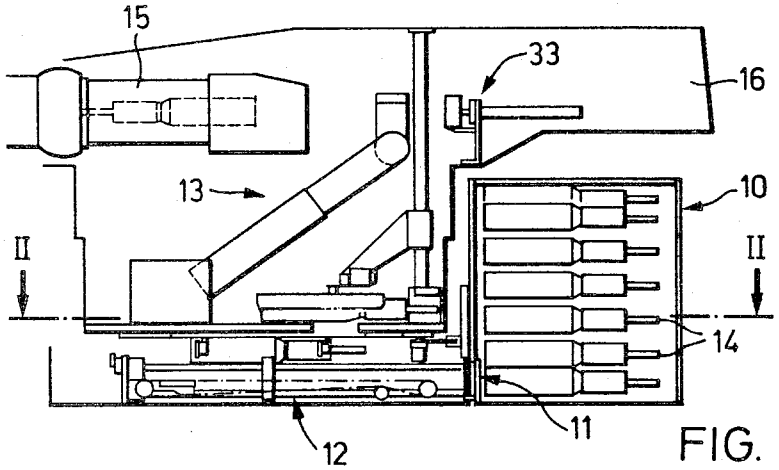
FIG. 1 is a vertical longitudinal sectional view through the complete automatic ammunition loading apparatus of the invention, taken substantially along the line I—I of FIG. 2.
Figure 2:
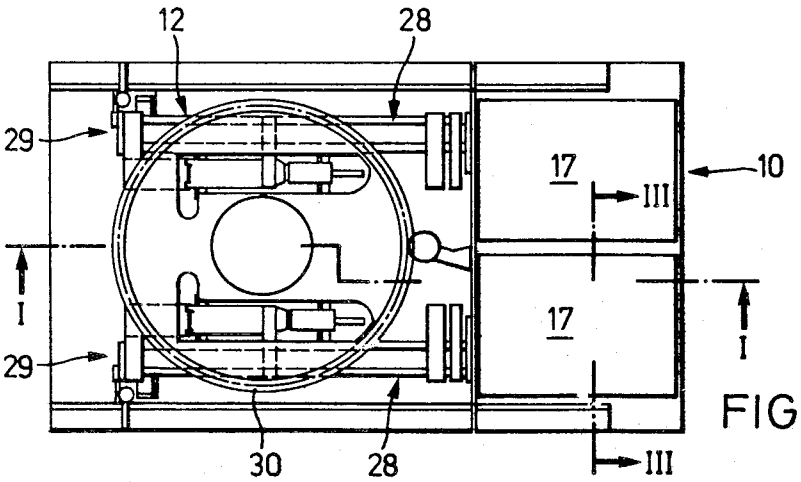
FIG. 2 is a horizontal sectional view of the arrangement of FIG. 1, taken substantially along the line II—II thereof.

Describing now the drawings, the exemplary embodiment of automatic loading apparatus illustrated in FIGS. 1, 2 and 3 will be understood to have the following components:

1. an ammunition magazine 10;
2. an ammunition chute or sluice 11;
3. a transfer station 12; and
4. an ammunition infeed device 13.

The components mentioned with reference to the items (3) and (4) above have the function of infeeding to a firing weapon 15 projectiles 14 removed from the ammunition magazine 10. The firing weapon 15 is located at an armored vehicle turret 16 which has only been schematically shown in the drawings to simplify the illustration. The ammunition magazine 10 is arranged in a not further illustrated armored vehicle behind the armored vehicle turret 16. The transfer station 12 is located below the armored vehicle turret 16. Between the transfer station 12 and the ammunition magazine 10 there is arranged the ammunition chute or sluice 11. The ammunition infeed device 13 is located internally of the armored vehicle turret 16 below the firing weapon 15.

Figure 4:
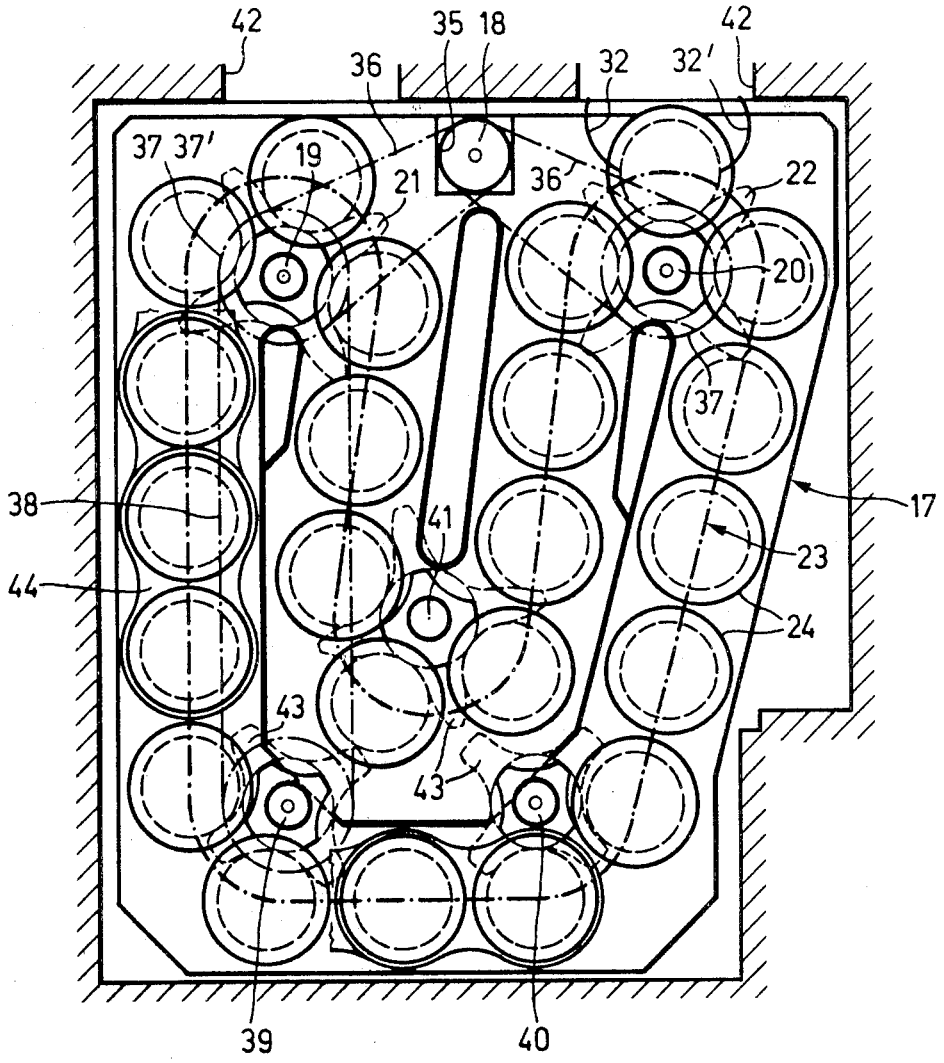
FIG. 4 is an enlarged fragmentary cross-sectional view of the arrangement of FIG. 3.

As will be recognized by referring to FIGS. 2, 3, 4 and 5 the ammunition magazine 10 contains the following components:

1. two magazine containers 17 (FIG. 2);
2. a respective drive 18 having the drive shafts 19, 20 and feed or conveyor star wheels or sprockets 21, 22 (FIG. 4); and
3. a respective band or belt chain 23 containing the ammunition receivers or casings 24 (FIG. 4).

Figure 5:
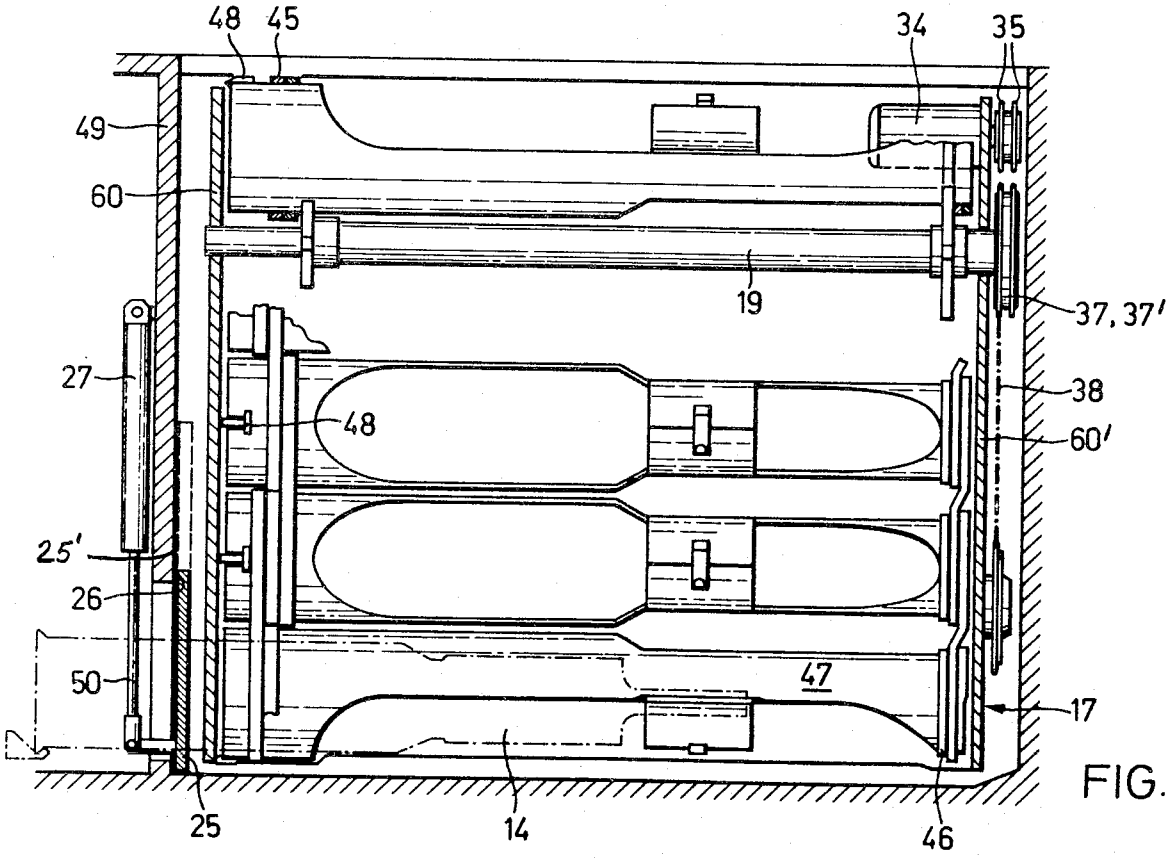
FIG. 5 is an enlarged fragmentary longitudinal sectional view of the arrangement of FIG. 1.

The magazine sluice or chute 11 contains, as will be seen from FIG. 5, the following components:

1. a trap door 25;
2. a conventional guide arrangement, which has merely, been schematically indicated in the drawings to preserve illustration;
3. a sealing device 26 shown in sectional view; and
4. an actuation cylinder 27.

Figure 6:
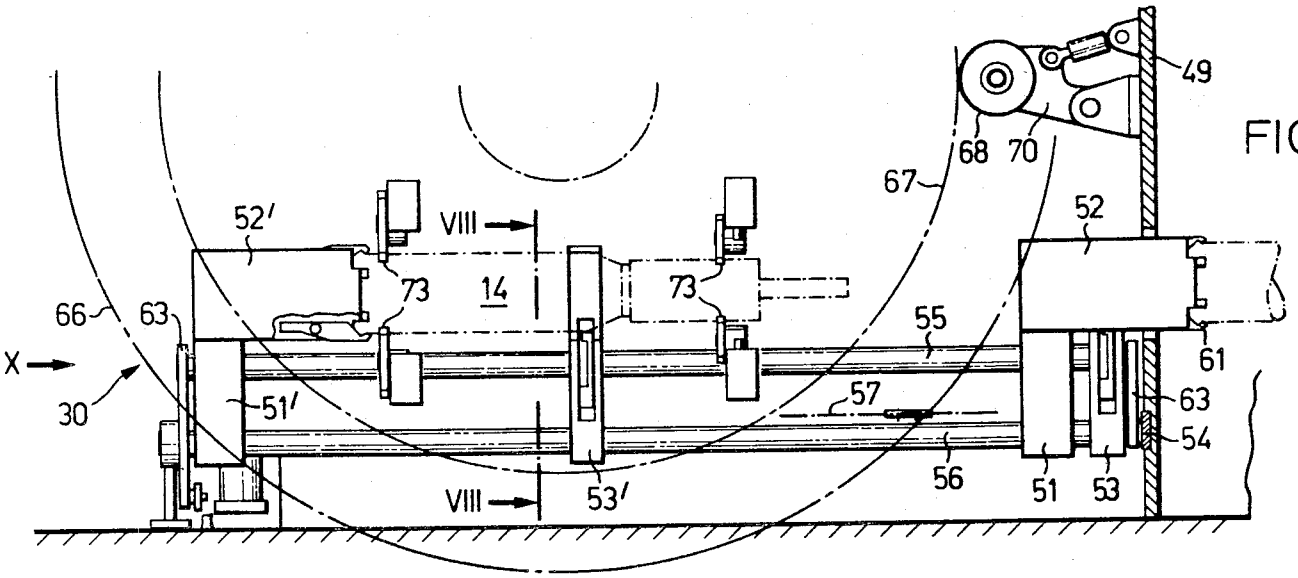
FIG. 6 is an enlarged fragmentary top plan view of the arrangement of FIG. 2.
Figure 7:
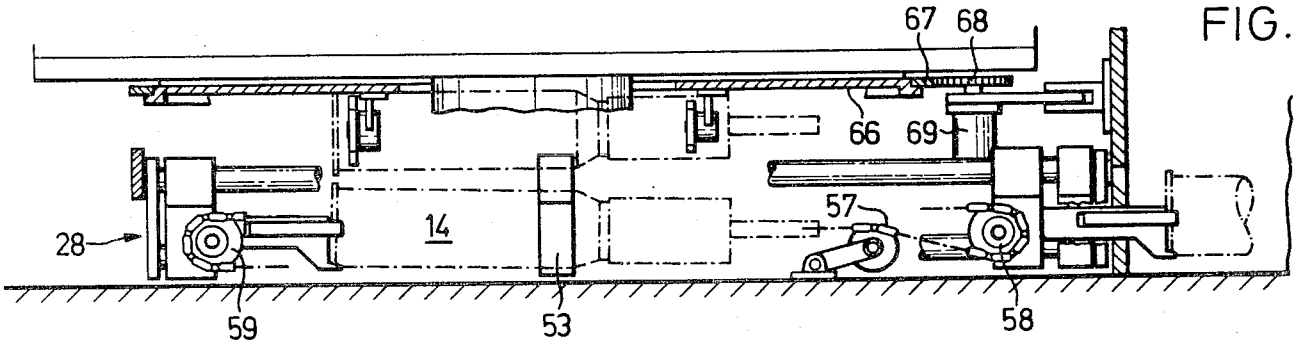
FIG. 7 is an enlarged fragmentary longitudinal sectional view of the arrangement of FIG. 1.
Figure 9:
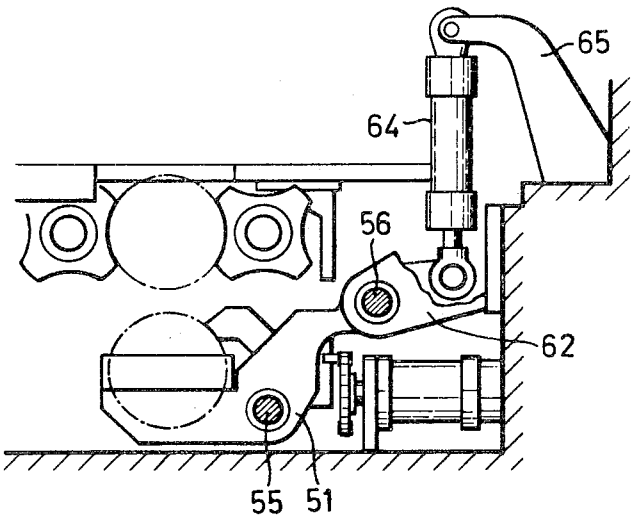
FIG. 9 is an enlarged front view, looking in the direction of the arrow X of FIG. 6, without the rocker arrangement.
Figure 8:
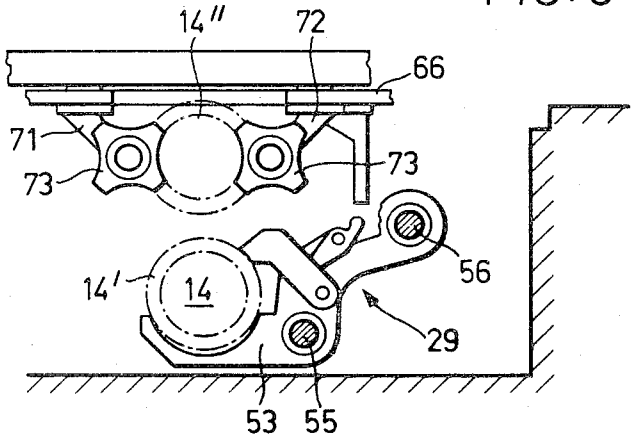
FIG. 8 is an enlarged sectional view, taken substantially along the line VIII—VIII of FIG. 6.
Figure 8A:
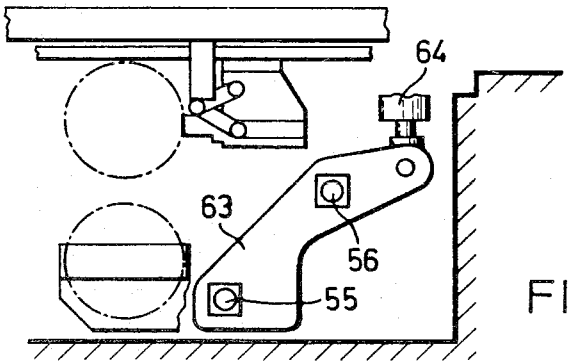
FIG. 8*a* is an enlarged front view, looking in the direction of the arrow X of FIG. 6, showing the rocker arrangement thereof.

As will be seen from FIGS. 6, 7 and 8 the transfer station 12 contains:

1. a withdrawal device 28 (FIGS. 1 and 7);
2. a pivot device 29 (FIGS. 3 and 8); and
3. a rotatable or rotary table 30 (FIGS. 2 and 6).

Figure 10:
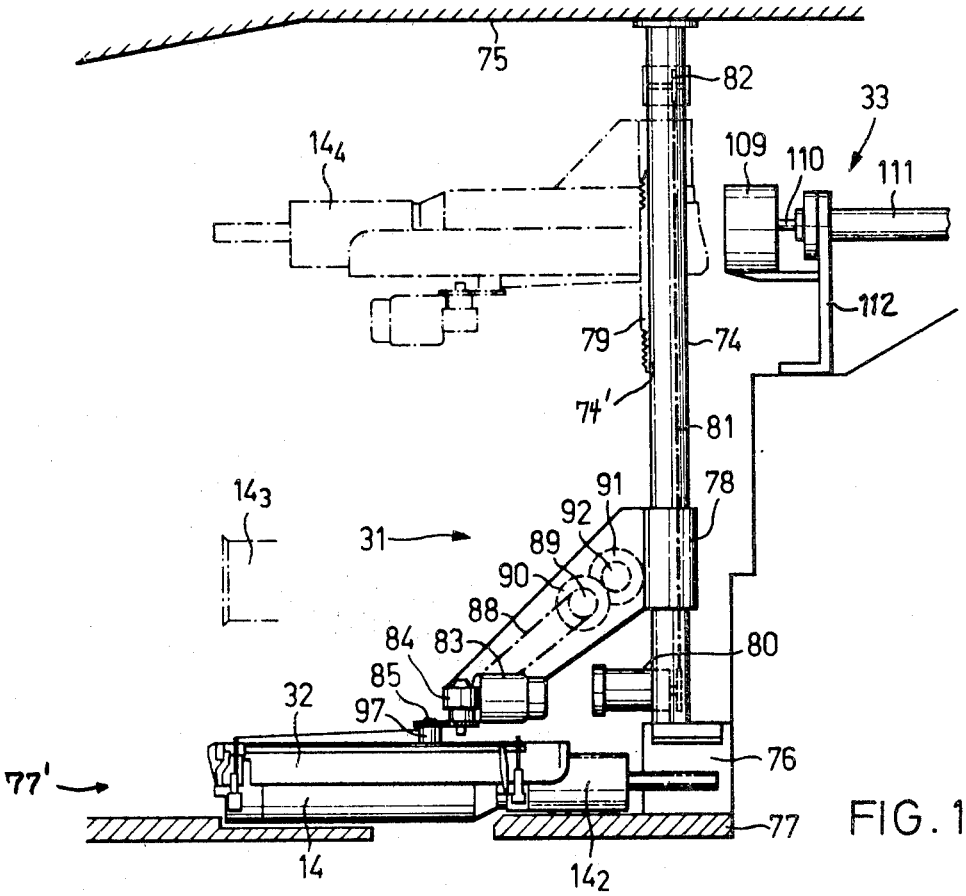
FIG. 10 is an enlarged fragmentary sectional view of the arrangement of FIG. 1.
Figure 10A:
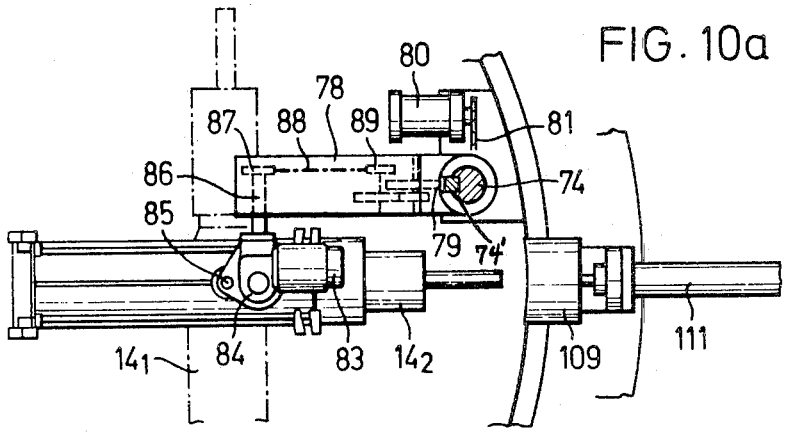
FIG. 10*a* is an enlarged front bottom view of the lifting or hoisting device shown in the arrangement of FIG. 10.
Figure 11:
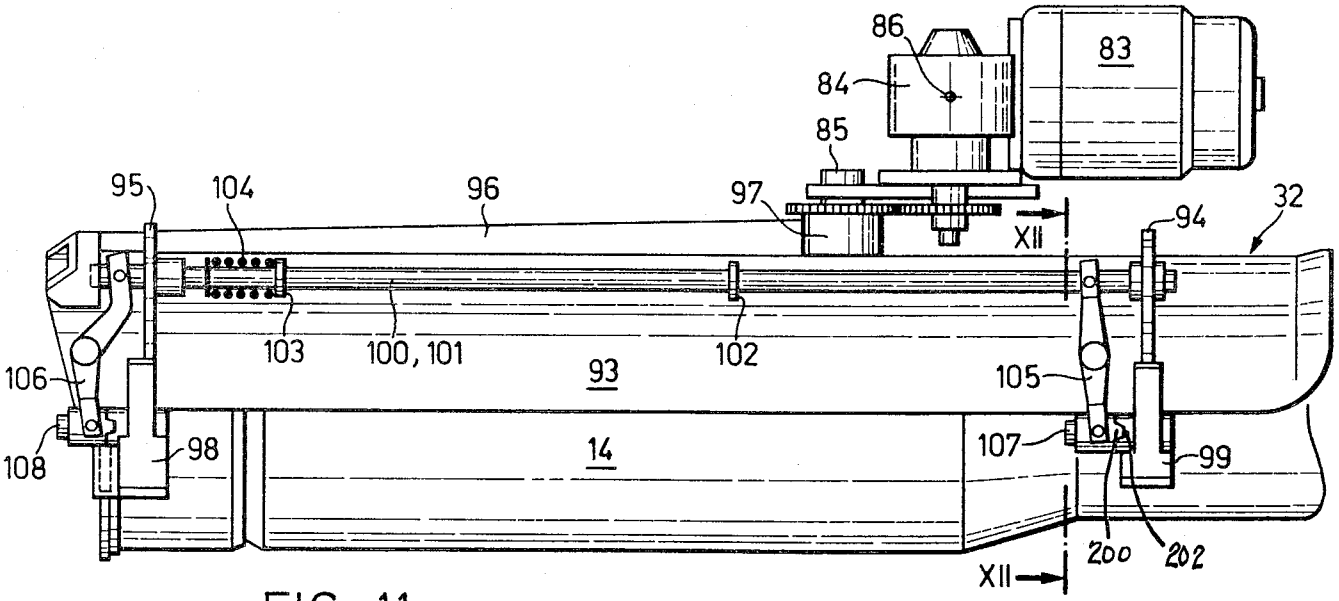
FIG. 11 is an enlarged front view of the loading shell or cradle of the arrangement of FIG. 10.

As shown in FIGS. 10 and 11 the ammunition infeed device 13 (FIG. 1) contains the following components:

1. a lifting or hoisting device 31 (FIGS. 10 and 10*a*);
2. a loading cradle or shell 32 (FIG. 11); and
3. a rammer or ramming device 33 (FIGS. 10 and 10*a*).

In the description to follow all of these components will be described in greater detail.

Ammunition Magazine

According to the showing of FIGS. 4 and 5 each of both magazine containers 17 has two end plates 60 and 60' which are interconnected with one another by four not particularly shown plates or equivalent connecting elements, i.e. are connected with one another at both sides as well as at the top and bottom. Rotatably mounted in both of these end plates 60 and 60' are the drive shafts 19 and 20 equipped with the conveyor sprockets or star-shaped wheels 21 and 22, respectively. At the rear end plate 60' there is secured a drive motor 34 internally of the magazine container 17. Operatively connected with the drive motor 34 are two sprocket wheels 35 which are located externally of the magazine container or receptacle 17. By means of both of the sprocket wheels 35 there are driven, as best seen by referring to FIG. 4, by means of two sprocket chains 36, on the one hand, the left drive shaft 19 and, on the other hand, the right drive shaft 20. Secured to the drive shaft 19 are two sprocket wheels 37 and 37', as best seen by referring to FIG. 5. One of these sprocket wheels 37 serves for receiving the aforementioned chain 36 and by means of the other sprocket wheel 37' there is driven, by means of a chain 38, a third drive shaft 39.

The magazine container 17 additionally contains two deflection shafts 40 and 41. When the ammunition receivers or casings 24 are located at the top at both of the conveyor sprockets 21 and 22, then they can be opened for the insertion of the projectiles 14. Above both of the feed or conveyor sprockets 21 and 22 the ammunition container 17 is provided with a respective ammunition hatch or opening 42. The endless band chain 23 with the ammunition receivers or casings 24, here assumed to constitute 23 ammunition receivers 24, travels from the first, uppermost drive shaft 19 to the lower drive shaft 39, over the first deflection shaft 40 to the second uppermost drive shaft 20 and from that location, over the second deflection shaft 41, back to the first upper drive shaft 19. The second deflection shaft 41 is resiliently mounted and serves for tensioning the chain 23. Arranged at each drive shaft 19, 20 and 39 as well as at each deflection shaft 40, 41 are the feed or conveyor sprockets or star-shaped wheels 21, 22 and deflection sprockets 43, respectively. The individual ammunition casings receivers 24 are interconnected with one another by links 44 in the manner of a roller chain. So that the receivers or casings 24 always arrive with the open side thereof facing upwardly towards the ammunition hatches or openings 42, they are fixedly connected in each case with one of the links or brackets 44 and rotatably mounted at the neighboring link or bracket 44. Such chain links or brackets 44 are provided at both ends of the ammunition receivers or casings 24, and the rear connection links travel in a suitable guide track and the band chain 23 together with the ammunition casings or receivers 24 are secured against axial shifting or displacement. Each ammunition casing or receiver 24 possesses two closed rings or ring elements 45 and 46, secured at both ends of a half or semi-circular shell or cradle 47.

As best seen by referring to FIG. 4, hingedly connected with each such half shell or cradle 47 is a bipartite closure element or cover 32', 32'', which prevents the projectile 14 from dropping out of the related ammunition receiver or casing 24. Furthermore, within each of the ammunition casings or receivers 24 there are provided holding claws 48 or equivalent structure, as best seen by referring to FIG. 5, which serve to secure the projectile 14 against axial shifting within the related ammunition receiver 24. All components arranged within the magazine container 17 are secured thereat in such a manner that the entire magazine container 17 can be removed out of the vehicle and still remains operationally reliable.

Magazine Sluice

As best seen by referring to FIG. 5, a trap or drop door 25 is displaceably guided, between a partition wall 49 and a magazine container 17, so as to be movable in two non-protruding guides or rails 25' which have merely been schematically indicated in the drawings. The trap door 25 together with a seal 26 possesses appreciable play in relation to the partition wall 49. At the opposite side of the partition or separation wall 49 there is secured an actuation cylinder 27, serving for raising and lowering the trap or drop door 25. A piston rod 50, protruding out of the actuation cylinder 27, is attached at the lower end of the trap door 25. The seal or seal means 26 becomes effective when there prevail excess pressure conditions within the magazine area. It comprises an endless, non-combustible sealing chord. When excess pressure conditions prevail in the magazine area or room, then the trap door 25 together with the thereat attached seal 26 is pressed against the partition wall 49. The arrangement of the actuation cylinder 27 at the room where the operating personnel of the armored vehicle is located has been selected for reasons of accessibility.

Transfer Station (Withdrawal device, Pivot device, Rotatable table)

As best seen by referring to FIGS. 6 and 7, the withdrawal or removal device 28 comprises a transport car or carriage 51 having a withdrawal head 52 and a support car or carriage 53. In the arrangement of FIG. 6 the transport car 51, withdrawal head 52 and support car 53 are shown completely towards the right both in their rearmost terminal position, where the withdrawal head 52 protrudes through the partition wall 49, and also in their forwardmost terminal position completely to the left of the showing of the drawing. In this position the corresponding components have been designated by reference characters 51', 52' and 53'. In the rearmost terminal position the support car or carriage 53 impacts against a guide track bracket 54 and the transport car or carriage 51 assumes a position just before the support car 53, while compressing a not particularly illustrated spring. In the forwardmost position of the transport car or carriage 51' this spring is relaxed and the support car or carriage 53' is located at a somewhat greater spacing behind the transport car 51' directly below the projectile or ammunition round 14.

Both the transport car 51 and also the support car 53 are displaceably guided upon two guide rods 55 and 56. An endless chain 57, trained about two sprocket wheels 58 and 59, serves for the displacement of the transport car 51 and the support car 53. For this purpose the transport car 51 is hingedly connected with the endless chain 57. The withdrawal head 52 possesses withdrawal claws 61, which during the rearward movement, upon engaging a projectile, simultaneously open the holding claws or pawls 48 within the ammunition receivers or casings 24 (FIGS. 4 and 5).

According to the showing in FIGS 6, 8, 8*a* and 9, the pivotal device 29 contains a bearing block 62 (FIG. 9) and a console or bracket 54 (FIG. 6). In such bearing block 62 and in the console or bracket 54 (FIG. 6) there is mounted at both of its ends the one guide rod 56. Two pivotal arms 63 (FIG. 6) are pivotably mounted at their intermediate part upon the guide rod 56 and carry at their left-hand end (FIG. 8*a*) the other guide rod 55. At the right-hand end of the one pivotal arm 63 there is articulated an actuation cylinder 64, which, in turn, is hingedly connected with a stationary bearing or pillow block 65. With the aid of the actuation or displacement cylinder 64 it is therefore possible to pivot the one guide rod 55 about the other guide rod 56, and the transport car 51 and the support car 53, guided upon the guide rods 55 and 56, are entrainably rocked or pivoted. Due to this pivotal movement of the transport car 51, as best seen by referring to FIG. 8, the projectile 14 which has been pulled out of the magazine 10 is raised out of its lower position 14' into its upper position 14''. In this upper position 14'' the projectile 14 arrives at the rotatable or rotary table 30 which will be described more fully hereinafter.

According to the showing of FIGS. 6, 7 and 8 the rotatable table 30 possesses a rotatable plate 66 at which there is attached a toothed rim 67 which meshes with a gear 68. This gear 68 is driven by a hydromotor 69 (FIG. 7) or equivalent drive. The hydromotor 69 is secured to the partition or separation wall 49 with the aid of a support 70 (FIG. 6). At the rotatable plate 66 there are provided four respective bearing or pillow blocks 71, 72 containing holder stars or sprockets 73 (FIG. 8) in order to receive two projectiles 14, and there will be apparent from the showing of FIG. 2 both of the receiving stations or locations.

The projectiles 14 which are transferred from the pivotal device 29 to the rotatable table 30 can be turned, by rotating the rotatable table 66 through 90°, in order to transfer such projectiles 14 to the lifting or hoisting device 31. From the showing of FIGS. 2 and 3, it will be seen that each magazine container 17 has operatively associated therewith a separate withdrawal or removal device 28 as well as a separate pivotal device 29. On the other hand, only a common rotatable table 30 is provided for both of the magazine containers 17, which rotatable table 30, however, possesses for each magazine container 17 a separate receiving location or station for the projectiles 14. There is also provided any suitable and therefore not particularly illustrated axial fixation of the projectiles 14 at the rotatable plate 66, which prevents the projectiles 14, during rotation of the rotatable table 30, from shifting in the axial direction.

The projectiles 14 which are infed to the rotatable table 30 from below can be seized from above by the lifting device 31 which will be described more fully hereinafter.

Ammunition Infeed Device

According to the showing of FIG. 10, the lifting or hoist device 31 possesses a column 74 which is secured at its upper end at the turret roof 75 and at its lower end, by means of a console or bracket 76, at the floor 77 of the turret cage 71'. This column 74 possesses a circular and flat guide 74' for the purpose of guiding a carriage 78. At the flat guide of the column 74 there is adjustably secured a rack 79. For raising and lowering the carriage 78 a hydraulic motor 80 or equivalent structure is attached at the lower end of the column 74. This hydraulic motor 80 drives a chain 81. The chain 81 is guided over a sprocket wheel 82 attached at the upper end of the column 74 and is fastened by means of both of its ends at the carriage 78. At the lower end of the carriage 78 there is pivotably attached the loading shell or cradle 32. This loading shell or cradle 32, as seen from the showing of FIG. 11, is rotated with the aid of an electric motor 83 and a transmission or gearing arrangement 84 about a shaft 85, which is vertically dispositioned in the lowermost position of the carriage 78. The gearing arrangement 84 with the electric drive motor 83 is secured to a horizontal shaft 86 (FIGS. 10 and 10*a* ), which is rotatably mounted at the lower end of the carriage 78. Upon the shaft 86 there is secured a sprocket wheel 87, which is driven by the aforementioned gear rack 79 by means of a chain 88 of a second sprocket wheel 89 and by means of three gears 90, 91, 92, when the carriage 78 moves up or down along the column 74.

According to the showing of FIGS. 10 and 10*a*, it is possible to initially raise the projectiles 14 out of the position $14_1$ through the floor 77 of the turret cage, with the aid of the carriage 78, and to pivot such projectile 14, with the aid of the electric motor 83, through 90° into the position $14_2$ about the vertical shaft 85. As also will be seen from FIG. 10, with the aid of the carriage 78 it is possible to hoist the projectile 14 out of the position $14_2$ into the position $14_3$, and then, with the aid of the gear rack 79, the three gears 92, 91 and 90 and the chain drive 89, 88, 87 to pivot the projectile 14 about the horizontal shaft 86 out of its lower horizontal position $14_3$, through an angle of about 180°, into the upper horizontal position $14_4$.

Figure 12:
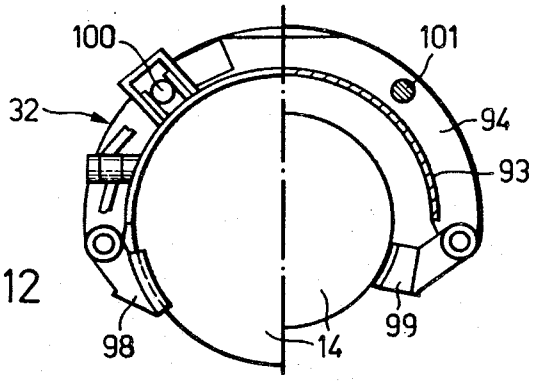
FIG. 12 is an enlarged sectional view of FIG. 11, taken substantially along the line XII—XII thereof.

According to FIGS. 11 and 12, the loading cradle or shell 32 possesses a receiver cradel or shell 93 which is reinforced by two frames or ribs 94 and 95. The reinforcement ribs 94 and 95 are connected with the rotatable bearing 97 by means of the longitidunal ribs 96. At both ends of both of the frames or ribs 94 and 95 there are pivotably connected holder clamps 98 and 99, serving to retain a projectile 14 in both radial and axial direction. Furthermore, there are provided means in order to fixedly retain the four holder clamps 98 and 99 or equivalent structure in their holding position. These means comprise two switching or control shafts 100 and 101 which are guided at both reinforcement ribs or frames 94 and 95 and in two support bearings 102 and 103. A compression spring 104 strives to shift the switching shafts 100 and 101, respectively, towards the left. This compression spring 104 bears at one end at the switching shafts 100, 101 and at the other end at the support bearing 103. Hingedly connected with each switching shaft 100, 101 are two switching levers 105, 106. These switching levers 105 and 106 are pivotably held at their center region and possess at their lower ends (in FIG. 11) switching cams or dogs 107 and 108 which coact with the holder clamps 98 and 99. For this purpose there are provided projections 200 at the switching cam or dogs 107 and 108 and which can penetrate into appropriate recesses 202 provided at the holder clamps 98 and 99.

Rammer Device

As best seen by referring to FIG. 10, the rammer device or rammer 33 possesses a casing or receiver 109 for receiving the projectile 14 from the position $14_4$. The receiver or casing 109 is secured to a piston rod 110 which protrudes into a work cylinder 111. The rammer casing or receiver 109 or equivalent structure is of tubular-shape and it is slotted at its circumference in accordance with the number of withdrawal claws. The drive cylinder 111 is secured to a bracket 112 or equivalent structure, which, in turn, is attached to the turret cage. This drive comprises a double-acting, double-stage telescopic cylinder arrangement.

Cartridge Sleeve Catch Device

Figure 13:
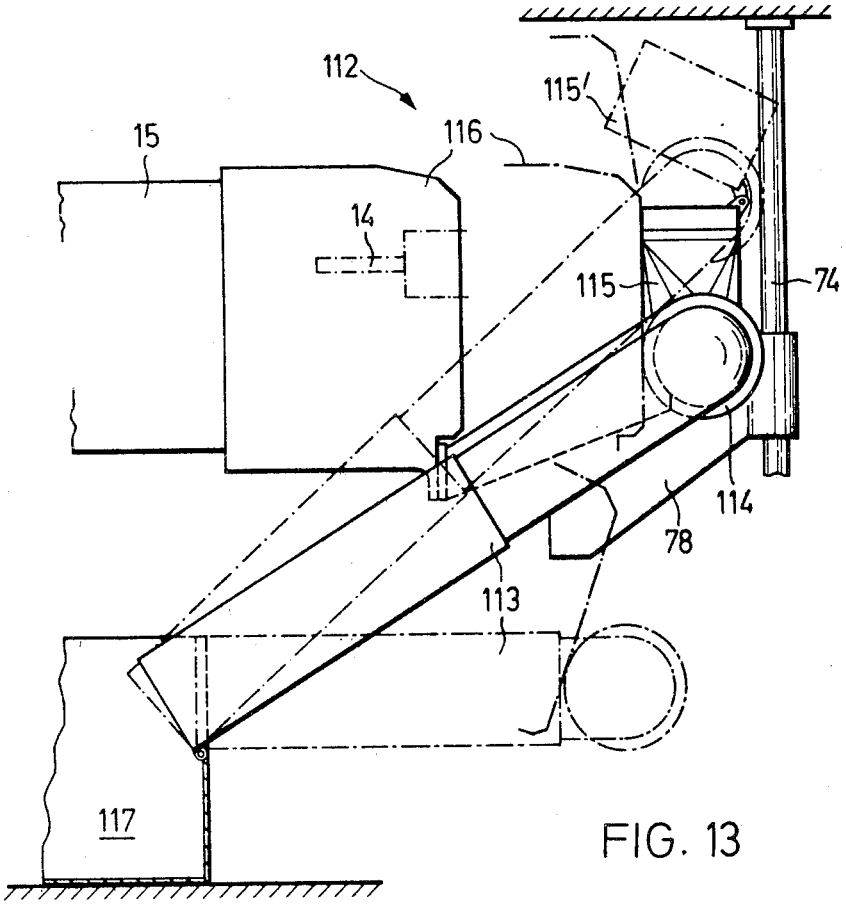
FIG. 13 is an enlarged side view of the cartridge or sleeve catch device.

According to the showing of FIG. 13, the sleeve catch device 112 comprises a withdrawal channel 113, which can be telescopically extended, and a hinge element 114 which participates in the movement of the weapon mount 116. At the hinge element 114 there is secured a catch box 115 which is located at the center of the weapon behind the return movement region. The withdrawal or removal channel 113 possesses an upright rectangular cross-sectional configuration, in which there is located adequate upright space for the ejected sleeve or cartridge portions. Below the firing weapon 15 there is arranged a catch box or cabinet 117 and such is accommodated in its size to the available installation space. The withdrawal channel 113 is pivotably hinged at its lower end at the catch box or cabinet 117. During loading of the weapon barrel the catch box 115 must be upwardly rocked into the position 115', in order to make space available for the loading cradle or shell 32 (FIG. 11) with the projectile 14. To this end, a control cam which has not been particularly shown in the drawing but is secured to the lifting carriage, engages into the guide of the catch box 115 and presses such together with the catch box upwards. When the ammunition is rammed and the lifting carriage is again lowered, then also the catch box returns into its starting position.

The mode of operation of the described automatic loading apparatus is as follows:

In order to fill projectiles 14 into both ammunition containers 17 of the ammunition magazine 10 initially both of the ammunition hatches 42 at the vehicle trough roof are opened, thereafter the ammunition casings or receivers 24, located at the region of such ammunition hatches 42, are opened, i.e. both of the elements 32' and 32'' of the closure or cover are upwardly pivoted towards the right and left, as the same will be apparent from the showing of FIG. 4. Now it is possible to simultaneously insert four projectiles 14 into both of the casings or receivers 24 of the one ammunition container 17 and into both casings 24 of the other ammunition container 17. So that the aforementioned ammunition hatches or openings 42 are accessible, it is necessary to pivot the armored vehicle turret 16 together with the firing weapon 15 into a suitable position. The closures or covers 32', 32'' of the receivers or casings 24 can be opened from the region of the vehicle trough or vat roof.

As will be apparent from FIG. 5, the projectiles 14 together with the cartridge sleeve bases are inserted at an inclination downwardly into the loading cradle or shell 32 of the ammunition casing or receiver 24 and can be shifted to such an extent forwardly until they latch at the holding claws of the casing 24. Thereafter, it is also possible to insert the cartridge tip portions. Then, the closures or covers 32', 32'' of the casing or receiver 24 are closed and the band chain 23 is moved further by one division or indexing step. This operation is repeated until both of the magazine containers 17 are filled. There can be introduced different types of ammunition, in a random sequence and number, into the casings or receivers 24. The filling station and the removal station are arranged such that when one of the ammunition casings or receivers 24 of the band chain 23 is located in its filling position, at the same time another ammunition casing 24 is located in the ammunition removal position. There are provided feelers which scan the type of ammunition present at the region of the withdrawal position or station or the empty ammunition casings or receivers 24. The magazine drive 18 renders it possible to bring, in both conveying directions, the selected type of ammunition into the withdrawal or removal position.

During emergencies, by opening a cover member at the upper region of the partition wall 49 there is accessible a casing position. A hand crank is inserted through the cover opening into engagement with one of the drive shafts 19, 20 and by rotating the same it is possible to bring the desired type of ammunition into the withdrawal or removal position. In order to remove the projectiles or shells 14 the holding claws at the ammunition casing or receiver 24 must be manually bridged.

In the event of explosions in the ammunition space or area the magazine sluice 11 maintains heat and pressure away from the operating crew. Before a projectile or shell 14 can be removed from the ammunition casing or receiver 24 located in the withdrawal position, it is necessary for the otherwise closed magazine sluice 11 to be opened. By means of the withdrawal device 28 there is actuated a conventional terminal switch, so that the actuation cylinder 27 now raises the trap door 25. As soon as the cartridge has been completely withdrawn, then the magazine sluice 11 is closed. The withdrawal device 28 is placed into operation by a control pulse and the transport car 51 together with the support car 53 move out of their starting position 51', 53' towards the rear in the direction of the magazine 10 into the position 51, 53 as soon as the magazine sluice 11 has been opened. The support car 53 is shifted towards the rear by the force of the not particularly illustrated spring or equivalent structure, until it impacts against the guide track bracket 53 or the like. Due to this displacement the clamping device at the ammunition casing 24 is released to such an extent so that the projectile is not contacted during the withdrawal operation. The transport car 51 presses the aforementioned spring against the support car 53 and the withdrawal head 52 penetrates into the magazine container 17. The withdrawal claws 61 or the like open, during such penetration, the axial fixation which retains the projectile 14 in the related ammunition casing or receiver 24. The withdrawal claws 61 finally latch into the cartridge sleeve base or floor of the projectile 14.

Upon reaching the rearmost position there is triggered the signal for the forward travel. The chain drive 57, 58, 59 is switched and draws the transport car 51 forwardly into its starting position 51'. The support car 53 follows at an adjustable spacing and arrives below the withdrawn projectile 14. Simultaneous with the starting of the support car 53 there is released the fixation of the projectile 14. Upon reaching the starting position the transport car 51 is frictionally locked by any suitable and therefore not particularly illustrated means, so that due to movements of the vehicle there do not arise any uncontrollable displacements. Upon reaching the starting position there is generated a signal for the next operation.

When the rotatable table 30 with its free receiver location or station is dispositioned over the withdrawal device 28, then the pivotal device 29 can be activated and there can be carried out the transfer of the projectile 14 from the transport car 51 to the rotatable table 30. For this purpose, the lifting cylinder 64 is activated and pivots the transport car 51 as well as the support car 53 with the thereupon located projectile 14 upwardly about the guide shaft 56. As a result, the projectile 14 arrives between both of the holder stars or sprockets 73 and is fixedly held by the same. At the same time there is released the radial fixation of the support car 33. As soon as the projectile 14 is located between the holder stars or star-shaped elements 73 of the rotatable 30, the pivot device 29 again arrives at its starting position, i.e., the transport car 51 and support car 53 are pivoted in the opposite direction about the guide shaft 56. As soon as this operation has been terminated, then it is possible to initiate the next step, namely, the rotation of the rotatable table 30.

The described transfer of the projectile 14 to the receiving station or location of the rotatable table 30 between the holder star-shaped elements 73 can only be accomplished in a predetermined position of the rotatable table 30, designated as the indexing position. The indexing position is controlled by not particularly illustrated but conventional terminal or end switches. After the projectile which has been raised by the pivotal device 29 and pressed between the holder star-shaped elements 73 of the rotatable table 30 has been released from the support car 53 then it is possible to rotate the rotatable table 30. The holder star-shaped elements 73 can be rotated only in one direction by a suitable reverse blocking device, in order to prevent unintentional dropping down of the projectile. The receiving location of the rotatable table 30 also possesses means for fixedly retaining the projectile 14 in axial direction. In both of the receiving locations of the rotatable table 30 there also can be provided two different types of projectiles 14. Depending upon which type of projectile is needed, the rotatable table 30 can be rotated in one or the other directional sense, in order to feed the one or the other type of projectile to the firing weapon. As soon as the desired type of ammunition has been determined, then the rotatable table 30 is rotated by the hydromotor 69 via the gear 68 and the toothed rim 67, until it reaches a location opposite the vehicle turret 16 in the indexing position.

As soon as the rotatable table 30 has reached its second indexing position, then the loading cradle or shell 32 lowers and moves through the turret floor 77 up to the region of the projectile 14 secured to the rotatable table 30 and the holder clamps 98, 99 (FIG. 12) seize such projectile 14. During withdrawal of the projectile 14 out of the holder star-shaped elements 73 of the rotatable table 30 the rotatable star-shaped elements 73 latch further through one step and thus again arrive at the receiving position. As soon as the projectile 14 has been held in the loading cradle 32, then the carriage 78 of the lifting or hoisting device 31 is raised upon the column 74, until the projectile 14 located transversely with respect to the firing weapon 15 is disposed above the turret floor 77. Now the loading cradle or shell 32 can be rocked about the shaft 85, until the projectile 14 has reached the position $14_3$ parallel to the firing weapon 50 and according to the showing of FIG. 10. After the removal of the projectile 14 out of the rotatable table 30 such is again pivoted back into its first indexing position and is therefore ready for receiving a further projectile 14 from the pivotal device 29. During further raising of the carriage 78 upon the column 74 the projectile 14 moves out of the position $14_2$ (FIG. 10) parallel to itself into the position $14_3$. During the upward motion of the carriage 78 upon the column 74, the gear 91 comes into engagement with the gear rack 79 and begins to rotate, with the result that the projectile 14 is raised out of the position $14_3$ and pivoted through 180° until it has reached the position $14_4$.

When the projectile 14 has reached the position $14_4$, then the rammer 33 is activated and such rams the projectile 14 into the barrel of the firing weapon 15.

During the ammunition infeed there should be distinguished between the first shot and the next following shot. During the first shot the starting position is constituted by the waiting position of the loading cradle or shell 32 with the projectile 14 in the position $14_3$ (FIG. 10). The loading cradle 32 is aligned at the center of the firing weapon 15 and is located in its overhead position, i.e. with the open cradle side pointed downwards. The firing weapon 15 is located in the indexed position 0°. When the type of ammunition has been selected and while the rotatable table 30 has been rocked into its transfer position, i.e. into the second indexing position, the loading cradle or shell 32 is simultaneously rocked or pivoted about the shaft 85 through 90° by the motor 83 in the requisite direction. If both the rotatable table 30 and also the loading cradle 32 have reached their position, then the loading cradle 32 lowers due to lowering of the carriage 78 down into the removal position. The opened holder clamps 98, 99 (FIG. 12) are activated by stationary stops and close. The switching cams 108 (FIG. 11) latch into recesses of the holding or holder clamps 98, 99. Hence, the projectile 14 is therefore secured both axially and radially against displacement within the loading cradle or shell 32. The loading cradle 32 again arrives in the aforementioned waiting or preparatory position and while rotated through 90°, until it is aligned parallel to the firing weapon 15. Thereafter, the projectile 14 is raised. If the carriage 78 moves upwardly upon the column 14, then the gear 91 comes into engagement with the gear rack 79 and by means of the gears 92 and 90 and the sprocket wheel 89, chain 88 and sprocket wheel 87, pivots the loading shell or cradle 32 through 180°. The loading cradle 32 is now upwardly directed with its open side and protrudes with its front portion into the firing weapon 15. Such constitutes the ramming position and the start of the ramming operation. After the rammer or ramming device 33 has moved through the advance displacement path, the casing or receiver 109 impacts against the control cams of the loading cradle 32, whereby the switching cams 107 and 108 (FIG. 11) unlatch and the holding claws 98, 99 open by spring force.

The withdrawal claws of the rammer 33 engage the projectile 14 and the casing 109 conveys the projectile 14 into the barrel of the firing weapon 15. Before reaching the terminal position the withdrawal claws of the rammer 13 impact against the barrel base, are held back and open. The rammer 33 moves into its terminal position and back into its starting position.

Depending upon whether or not there is available the type of ammunition desired for the next following shot or round firing, there are two variations possible for the function of the equipment:

1. For the next following shot the loading casing 32 with the selected projectile 14 is in its preparatory or waiting position. Once the first shot has been fired and there has been terminated the weapon recoil, the weapon 15 is rocked into the indexed position 0°. At the same time there begins the stroke of the projectile 14 and the pivoting of the loading casing or receiver 32 into the ramming position.
2. For the following shot the empty loading cradle or shell 32 is in the preparatory position. After the first shot has been fired and the weapon recoil has terminated, then the weapon 15 pivots into the indexed position 0°. Only after there has been selected the type of ammunition desired for the following shot is it possible for the rotatable table 30 and the loading casing 32 to be placed into movement in order to receive ammnition.

It is to be understood that the term projectile is used throughout this disclosure and appended claims in its broader sense to mean ammunition or rounds of ammunition, i.e. any type of ordnance which can be handled by the loading apparatus of the invention.

While there are shown and described present preferred embodiments of the invetion, it is to be distinctly understood that the invention is not limited thereto, but may be otherwise variously embodied and practiced within the scope of the following claims. Accordingly,

What we claim is:

1. An automatic ammunition loading apparatus for an armored vehicle containing a rotatable vehicle turret and a firing weapon, in order to infeed projectiles to the firing weapon, comprising:

an ammunition magazine;

said ammunition magazine containing:

at least one ammunition container;

a respective drive each having drive shafts; and a respective endless band chain means cooperating with said drive shafts;

a magazine sluice arranged between the ammunition magazine and the vehicle turret;

said magazine sluice containing:

a trap door; and an actuation cylinder for opening and closing said trap door;

a transfer station;

said transfer station containing:

a withdrawal device for withdrawing projectiles out of the ammunition magazine through said magazine sluice;

a pivot device; and a rotatable table to which there are infed projectiles by means of said pivot device; and an ammunition infeed device;

said ammunition infeed device containing:

a lifting device for lifting the projectiles from the rotatable table below the vehicle turret up to the region of the firing weapon;

a loading cradle for receiving the projectile to be raised;

said loading cradle being secured at said lifting device; and a ramming device for ramming the raised projectile into the firing weapon.

2. The automatice loading apparatus as defined in claim 1, wherein:

said drive of said ammunition container comprises a drive motor;

two sprocket wheels secured to said drive motor;

two chains;

two further sprocket wheels;

said drive shafts comprising two drive shafts driven by said two sprocket wheels by means of said two chains and said two further sprocket wheels;

a further sprocket wheel member arranged at one of the drive shafts;

a further chain member;

a third drive shaft; and said further sprocket wheel member driving said third drive shaft by means of said further chain member.

3. The automatic loading apparatus as defined in claim 2, further including:

two deflection shafts in addition to said three drive shafts provided for said ammunition container;

conveyor star-elements secured at said drive shafts and said deflection shafts in order to receive ammunition casings;

ammunition casings for receiving the projectiles; and bracket means for uniting said ammunition casings into said endless band chain means.

4. The automatic loading apparatus as defined in claim 3, wherein:

said projectiles when inserted into said ammunition casings extend rearwardly by means of their projectile tip, viewed with respect to the direction of travel of the armored vehicle.

5. The automatic loading apparatus as defined in claim 4, wherein:

each of said ammunition casings comprises a semi-circular casing shell and a bipartite cover.

6. The automatic loading apparatus as defined in claim 1, further including:

a partition wall;

said trap door of the magazine sluice being arranged between said partition wall and said magazine container; and said actuation cylinder for opening and closing said trap door being arranged between said partition wall and the vehicle turret.

7. The automatic loading apparatus as defined in claim 1, wherein:

said withdrawal device comprises a transport car equipped with a withdrawal head and a support car and guide track means;

two guide shafts provided for said withdrawal device;

two pivotal arms;

one of the guide shafts being pivotably mounted at said two pivotal arms for pivotal movement about the other guide shaft; and said transport car together with said withdrawal head and said support car being displaceably arranged upon both guide shafts.

8. The automatic loading apparatus as defined in claim 7, wherein:

said withdrawal device comprises a chain drive means; and said chain drive means including a chain element guided over two sprocket wheels.

9. The automatic loading apparatus as defined in claim 1, wherein:

said ammunition magazine contains two of said magazine containers;

said rotatable table possesses two receiving locations;

one of said receiving locations being operatively correlated with one of said magazine containers and the other receiving location with the other magazine container;

each receiving location having four holding star-shaped elements; and each of said holding star-shaped elements being rotatably mounted at a bearing block.

10. The automatic loading apparatus as defined in claim 9, wherein:

said rotatable table comprises a rotary plate;

said rotary plate being arranged coaxially with respect to and below said vehicle turret;

hydromotor means provided for said rotatable table; and said hydromotor means driving said rotatable table by means of a gear secured to said hydromotor means and by means of a toothed rim attached at the rotatable table.

11. The automatic loading apparatus as defined in claim 10, wherein:

said projectile in the receiving location of the rotatable table extends rearwardly with its projectile tip, viewed with respect to the direction of travel of the vehicle and upon rotation of the rotatable table can be rotated into a removal position through an angle of about 90°; and said projectile of the one magazine container, following such rotation, and viewed with respect to the direction of vehicle travel, having its projectile tip directed in one direction and the projectile of the other magazine having its projectile tip directed in an opposite direction.

12. The automatic loading apparatus as defined in claim 1, wherein:

said lifting device comprises a vertical column;

said vertical column having an upper end which is secured at a ceiling of the turret and a lower end connected by bracket means with the base of a turret cage;

carriage means displaceably guided at said column;

a loading cradle carried by said carriage means;

means mounting said loading cradle so as to be pivotable about a horizontal axis and about a vertical axis; and electric drive motor means and gearing means for pivoting the loading cradle about the vertical axis.

13. The automatic loading apparatus as defined in claim 12, further including:

gear rack means secured to said column;

a gear rotatably mounted at said carriage means;

said gear meshing with said gear rack means;

two further gears mounted at said carriage means;

said gear pivoting by means of said two further gears and by means of a chain drive said loading cradle about its horizontal axis; and said chain drive comprising two sprocket gears and a sprocket chain mounted at said carriage means.

14. The automatic loading apparatus as defined in claim 1, wherein:

said loading cradle having opposed ends;

each of said opposed ends being provided with reinforcement rib means; and two holder clamp means hingedly connected with each reinforcement rib means in order to retain the projectile in its related loading cradle.

15. An automatic ammunition loading apparatus for an armored vehicle containing a rotatable vehicle turret and a firing weapon, in order to infeed rounds of ammunition to the firing weapon, comprising:

an ammunition magazine;

said ammunition magazine containing:

at least one ammunition container;

drive means provided for said ammunition container;

a driven means cooperating with said drive means for moving ammunition within said ammunition container;

a magazine sluice arranged between the ammunition magazine and the vehicle turret;

said magazine sluice containing:

a movable closure; and an actuation means for opening and closing said movable closure;

a transfer station;

said transfer station containing:

a withdrawal device for withdrawing rounds of ammunition out of the ammunition magazine through said magazine sluice;

a pivot device; and a rotatable table to which there are infed rounds of ammunition by means of said pivot device; and an ammunition infeed device;

said ammunition infeed device containing:

a lifting device for lifting the rounds of ammunition from the rotatable table below the vehicle turret up to the region of the firing weapon;

a loading cradle for receiving the round of ammunition to be raised;

said loading cradle being secured at said lifting device; and a ramming device for ramming the raised round of ammunition into the firing weapon.

* * * * *